United States Patent [19]

Pardini et al.

[11] Patent Number: 4,916,421

[45] Date of Patent: Apr. 10, 1990

[54] CONTACT ARRANGEMENT FOR A CURRENT LIMITING CIRCUIT BREAKER

[75] Inventors: Franco Pardini; Tonino Benetti, both of Milan, Italy

[73] Assignee: General Electric Company, New York, N.Y.

[21] Appl. No.: 251,492

[22] Filed: Sep. 30, 1988

[51] Int. Cl.[4] ..... H01H 3/00

[52] U.S. Cl. ..... 335/185; 335/195; 335/16

[58] Field of Search ..... 335/16, 147, 195, 168, 335/185, 186, 189, 196; 200/147 R

[56] References Cited

U.S. PATENT DOCUMENTS 3,533,027 10/1970 Hanafusa et al. ..... 335/16
3,559,119 1/1971 Koennecke et al. ..... 335/16
4,616,198 10/1986 Pardini ..... 335/16
4,649,247 3/1987 Preuss et al. ..... 335/195

*Primary Examiner*—Leo P. Picard
*Assistant Examiner*—Lincoln Donovan
*Attorney, Agent, or Firm*—Richard A. Menelly; Walter C. Bernkopf; Fred Jacob

[57] ABSTRACT

A current limiting circuit interrupter consisting of a modular unit housed in an insulating case and provided with two fixed contact arms and two movable contact arms. The movable contact arms can be actuated automatically by means of a rod coupled to an operating mechanism as well as by means of an electromagnetic actuator. The operating mechanism includes a lever and a rotating bracket arranged to hold the movable contacts in an open condition when the electromagnet within the electromagnetic actuator is de-energized.

8 Claims, 2 Drawing Sheets

CONTACT ARRANGEMENT FOR A CURRENT LIMITING CIRCUIT BREAKER

BACKGROUND OF THE INVENTION

This invention relates to that described within U.S. Pat. No. 4,616,198 issued to Franco P. Pardini. The Pardini Patent discloses a circuit interrupter wherein the movable contact arms are capable of movement independent from the circuit breaker operating mechanism. The contact arms are electrically connected together by means of a flexible conductor braid and are adapted for rotation in opposite directions by means of a pair of driving rods connected to a push rod which is separately actuated.

Repeated rotation of the contact arms within the aforementioned circuit interrupter over long periods of operation can excessively stress the flexible conductor braid. The complex operating mechanism required for the contact arms utilizes a separate support member for each of the contact arms which substantially increases the manufacturing costs.

SUMMARY OF THE INVENTION

The invention comprises a current limiting circuit interrupter wherein the movable contact arms are both manually operated as well as operated by an electromagnetic actuator. The movable contact arms are pivotally arranged for rotating in the same direction to an open position by means of a single rotating member and are arranged for remaining in their open position when the electromagnetic actuator is de-energized.

DESCRIPTION OF THE PREFERRED EMBODIMENTS

Figure 1:
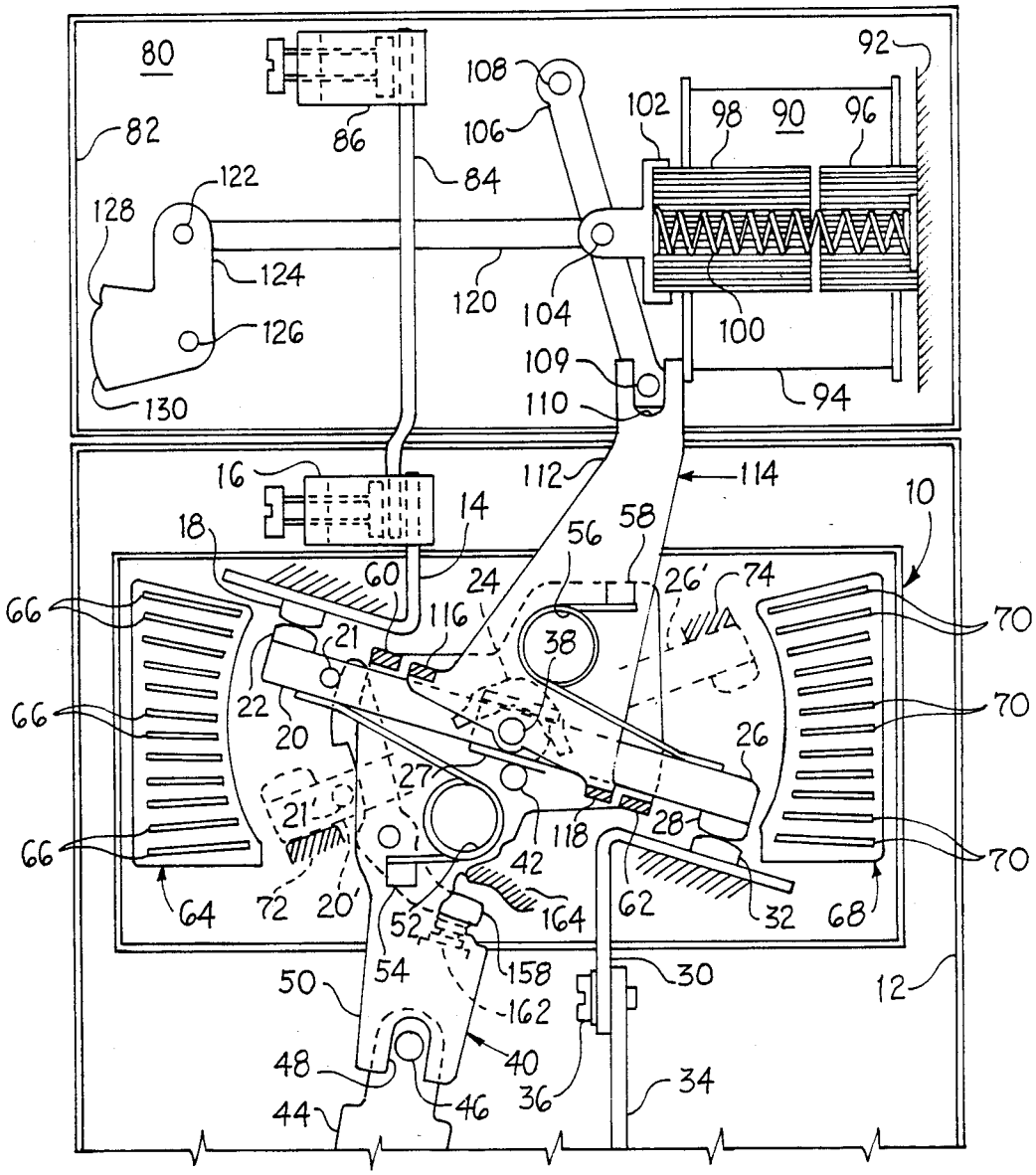
FIG. 1 is a side view of a circuit interrupter containing the contact arrangement according to the invention.

FIG. 1 shows a circuit interrupter including the contact arrangement according to the invention, housed in a case 12 and consisting of a first fixed contact arm 14 which supports, at a first end thereof, a terminal connector 16 and, at a second end thereof, a first fixed contact 18. A first movable contact arm 20 supports a first movable contact at one end 22 and a flexible braided conductor 24 at one end and supports a second movable contact 28 at an opposite end thereof. A second fixed contact arm 30 which supports a second fixed contact 32 is fastened to an output terminal strap 34 by means of a screw 36.

The first and second movable contact arms 20 and 26 are arranged for rotating about a pivot pin 38 fastened to a support lever 40 which is in turn arranged for rotating about a pin 42 fixedly attached to the case 12. The second movable contact arm 26 is provided with a projection 27 arranged to prevent the first and second movable arms from being displaced beyond a fixed limit. The projection 27 can also be coupled to the other movable contact arm 20.

The support lever 40 is driven to the position shown in FIG. 1 by means of a rod 44 which operates through a pin 46 coupled to the rod which extends within a slot 48 formed within the end 50 of the support lever 40. The rod 44 is attached to the circuit interrupter operating mechanism (not shown).

The first movable contact arm 20 is held in the position shown in FIG. 1 by means of a first torsion spring 52 which is biased between a projection 54, formed on the support lever 40 and the surface of the first movable contact arm 26 opposite the second movable contact 32. The second movable contact arm 26 is held by means of a second torsion spring 56 which is biased between a projection 58 formed on the supporting lever 40 and the surface of the second movable contact arm 26 opposite the second movable contact 32.

The support lever 40 is also provided with a pair of projections 60 and 62 which contact the first and second movable contact arms when the support lever is rotated counterclockwise and drives the movable contact arms to the open position as indicated in phantom at 20', 26'. Two projections 72, 74 formed on the case 12 operate as stops for the respective movable contact arms 20 and 26 as they are brought by electrodynamic repulsion to the positions 20', 26'. The first fixed and movable contact arms 14, 20 are arranged in front of a first arc chute 64 containing arc quenching plates 66. The second fixed and movable contact arms 30, 26 are arranged in front of a second arc chute 68 containing arc quenching plates 70. Although only a single pair of first and second fixed and movable contact arms are depicted, additional pairs can be used within multiple circuit interrupters.

Figure 2:
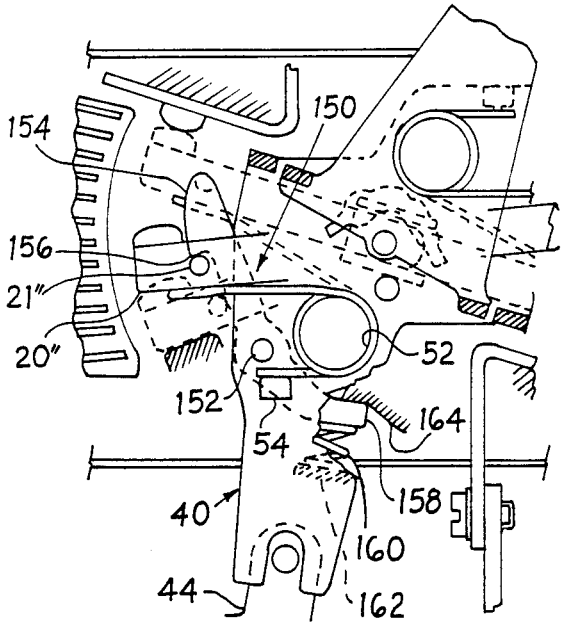
FIG. 2 is a cutaway side view of the contact arm of FIG. 1 detailing the movable contact arm latching mechanism.

The latching arrangement for the movable contact arms can best be seen by referring to both FIGS. 1 and 2 wherein a lever 150 is arranged about a pivot pin 152 and is provided with a detent 156 at the angled end 154. The opposite end of the lever terminates in a flat surface 158 which is biased against a shaped step 164 on the case by means of one end of a compression spring 160. The opposite end of the compression spring is supported on a projection 162 extending from the support lever 40. The latching arrangement just described operates to prevent the first movable contact arm 20 from rebounding off the stop 72 when the first movable contact arm moves from the closed position depicted at 20 in FIG. 1 to the open position depicted at 20'' in FIG. 2. Upon the occurrence of a short circuit condition, the first movable contact arm 20 becomes electrodynamically repulsed away from the first fixed contact arm 14 and is driven counterclockwise about the pivot pin 38. A pin 21 extending from the first movable contact arm 20 moves along the angled end 154 of lever 150 and becomes captured under the detent 156 on the lever and is held under the detent by the bias provided by the compression spring 160 as depicted at 21'' in FIG. 2. In the absence of the latching arrangement, the first movable contact arm would otherwise bounce off the stop 72 and return in the clockwise direction under the urgence of the first torsion spring 52. Upon articulation of the current limiter operating mechanism, the support lever 40 rotates in the clockwise direction causing the flat surface 158 to contact the shaped step 164 causing the lever 150 to rotate in the counterclockwise direction, thereby releasing the pin 21 out from under the detent 156 to return along with the first movable contact arm to the position indicated at 21'' in FIG. 1.

The electromagnetic actuator 80 enclosed within a separate case 82 connects with the circuit interrupter 10 by means of an extended conductor 84 which extends between the terminal lug 86 within the electromagnetic actuator and the terminal connector 16 within the circuit interrupter 10. It is to be noted that the electromagnetic actuator interconnects with the circuit interrupter in a modular fashion. Electrical connection is made by means of the extended conductor 84 and mechanical connection is made with the circuit interrupter by means of the connecting lever 114 which will be discussed below in greater detail. Also contained within the separate case 82 is the electromagnet 90 shown attached to the case by means of a support 92. The electromagnet consists of a winding 94 arranged around a fixed core and a movable armature 98. The armature is attached to the support 92 by means of a return spring 100 which extends between the support and a bracket 102 carried by the electromagnet. An operating lever 106 pivotally connects with the bracket 102 by means of a pin 104 and is in turn pivotally attached within the case by means of a pin 108. A fixed pin 109 projecting from the opposite end of the operating lever is captured within a slot 110 formed within the end 112 of the circuit interrupter connecting lever 114. Rotation of the connecting lever about its pivot pin 38 in turn drives both the first and second movable contact arms 20, 26 to the open position by striking the contact arms with the projections 116, 118 provided on the ends of the connecting lever. The same pin 104 connects with one end of the driving rod 120 which is attached to a bell crank lever 124 at an opposite end by means of a pin 122. The bell crank lever is pivotally attached within the case by means of a pivot pin 126. The end of the bell crank lever facing an indicating window 130, formed in the separate case 82, is provided with indicia 128 to indicate the "ON" and "OFF" conditions of the fixed and movable contacts 18, 32, 22, 28.

As described earlier, the electromagnetic actuator 80 is easily added to or removed from the circuit interrupter 10 without interfering with the circuit interrupter components. When the electromagnet 90 is de-energized, the armature 98 returns to its initial position under the urgence of the return spring 100. This rotates the lever 106 counterclockwise, thereby driving the connecting lever 114 counterclockwise to rotate the first and second movable contact arms 20, 26 away from the first and second fixed contacts 22, 32.

Figure 3:
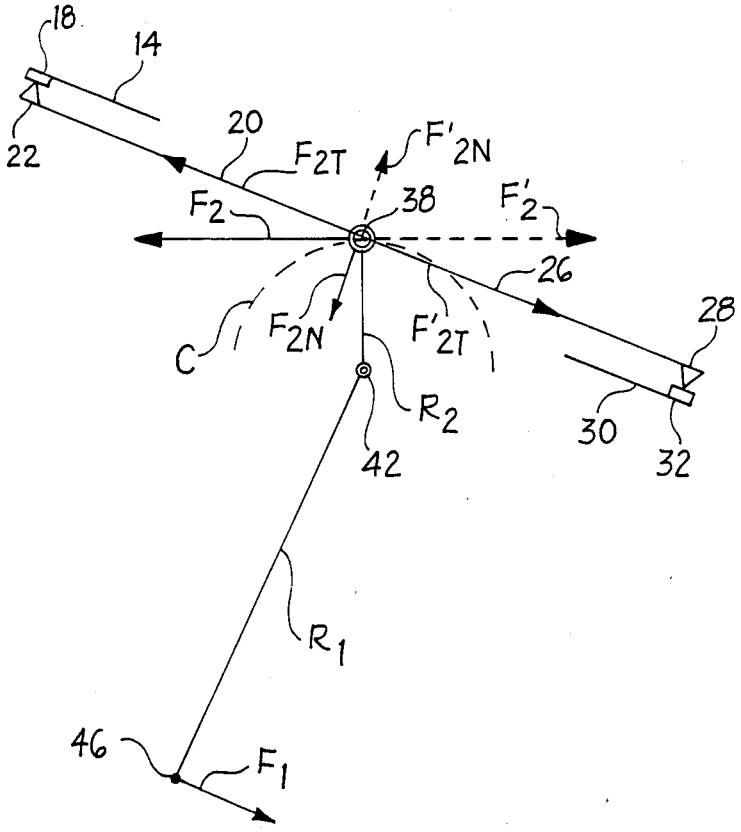
FIG. 3 is a schematic representation of the force vectors applied to the movable contact arms within the contact arrangement of FIGS. 1 and 2.

As best seen in FIGS. 1 and 3, the pin 42, about which the support lever 40 rotates, does not coincide with the pivot pin 38, about which the first and second movable contact arms are constrained to rotate. The force vectors applied to the first and second movable contact arms 20, 26, depicted in FIG. 3, are indicated by arrows 20, 26. The distance along the support lever 40 between its pivot pin 42 and the pin 46 on rod 44 is depicted as RI, while the distance along the support lever between the pivot pin 42 and the pivot pin 38 for the first and second movable contact arms is depicted as $R_2$.

As a force $F_1$ is applied to pin 46 arranged at one end of $R_1$, this force operating about pin 42 as a fulcrum, will be transformed into a rotational force $F_2$ applied to pivot pin 38 tangential to a circle C of radius $R_2$ centered on pin 42 and passing through the pivot pin 38.

The lines representing the movable contact arms 20 and 26 do not coincide with the direction of force $F_2$. Hence the force can be considered to consist of the vectorial sum of a component $F_{2T}$ tangent to the lines representing the movable contact arms 20 and 26 and a component $F_{2N}$ perpendicular thereto.

The tangential component $F_{2T}$ transmits a stress parallel to the arms upon opening of the contacts, which causes the fixed contacts 18 and 32 and movable contacts 22 and 28 to rub against each other. The normal or perpendicular component $F'_{2N}$ which applied to the pivot pin 38, the hinged ends of the movable contact arms toward pin 42 which tends to rub the movable contacts against the corresponding fixed contacts. The rubbing of the movable contacts against the fixed contacts beneficially breaks any welding formed during a particularly intense overcurrent condition through the contacts.

$F'_2$, $F'_{2T}$ and $F'_{2N}$ depict the forces involved during the closing of the contacts which cause the contacts to rub against each other to beneficially clean the contact surfaces as well as lessen the tendency for the contacts to bounce away during the closing operation.

When the circuit interrupter is operated without the electromagnetic actuator 80, the movable contact arms are held in their closed condition as long as the support lever 40 is held in the position indicated in FIG. 1 and the current through the contacts remains within rated values.

Still referring to FIG. 1, if a short circuit should occur, the current rapidly increases to a value sufficient to cause electrodynamic repulsion between the respective fixed and movable contact arms 14, 20 and 26 which are driven to their opened positions 20' and 26' by overcoming the holding forces of their respective springs 52 and 56, as long as the short circuit current exists.

Under the bias provided by the first torsion spring 52, movable contact arm 20'' is brought to the latched position fixed by the engagement of pin 21'' under the detent 156 of the latching mechanism. As best seen in FIG. 2, upon tripping of the circuit interrupter operating mechanism (not shown), the support lever 40 rotates clockwise striking the flat surface 158 at its end against the shaped step 164 which rotates the lever 150 in the clockwise direction to disengage thereby the pin 21'' from under the detent 156, thereby also unlatching the movable contact arm 20''.

When the circuit interrupter is operated in association with the electromagnetic actuator 80, the support lever 40 and the movable contact arms 20, 26 are in the position indicated in FIG. 1, with the connecting lever 114 held by means of the attraction between the movable armature 98 and the fixed core 96. When the electromagnet 90 becomes de-energized, the armature is driven away from the core under the urgence of the return spring 100 rotating the connecting lever 114 counterclockwise by interaction of the fixed pin 109 on the operating lever 106 within slot 110 on the end of the connecting lever. Rotation of the connecting lever strikes the projections 116, 118 on the connecting lever against the movable contact arms 20, 26, driving the movable contact arms against the bias of the torsion springs 52, 56 to their open positions. The contacts 18, 22 and 28, 32 can only be closed when the rod 44 which interconnects with the circuit interrupter operating mechanism is in its closed position and the electromagnet 90 within the electromagnetic actuator 80 is energized. The movable contact arms 20, 26 can be rotated to the closed position shown in FIG. 1 whether the electromagnet is energized or not.

Having thus described our invention, what we claim as new and desire to secure by Letters Patent is:

1. A current limiting circuit interrupter comprising:

a first insulative case;

a pair of movable contact arms electrically connected together and supported within said first case by means of a first pivot pin, movable contact arms extending away from each other, said pair of movable contact arms being electrically connected together by means of a flexible braid;

a pair of movable contacts within said first case arranged at opposite ends of said pair of movable contact arms and facing in opposite directions from each other;

a corresponding pair of fixed contacts within said first case arranged for electrical connection with said movable contacts and facing in opposite directions from each other;

a support lever pivotally mounted within said first case by means of a second pivot pin and arranged for rotating said movable contact arms to an open position whereby said movable contacts are out of electrical connection with said movable contacts, said first pivot pin being attached to said support lever, one end of said support lever being adapted for interacting with a circuit interrupter operating mechanism;

an electromagnetic actuator in a second insulative case abutting said first case; and a connecting lever pivotally supported within said first case and adapted for interacting with said electromagnetic actuator for rotating said movable contacts arms to said open position.

2. The current limiting circuit breaker of claim 1 including a latching lever pivotally arranged within said first case and having a detent formed in one end thereof for capturing a pin extending from one of said movable contact arms to restrain said one movable contact arm in said open position.

3. The current limiting circuit breaker of claim 1 including a flat surface on said latching lever formed on an end of said latching lever opposite said one end and a compression spring trapped between said flat surface and a projection arranged within said first case, said compression spring biasing said detent into engagement with said pin.

4. The current limiting circuit breaker of claim 1 wherein said first pivot pin is arranged eccentric to said second pivot pin whereby rotation of said movable contact arms slides said movable contacts against said fixed contacts to break any welding that may occur between said fixed and movable contacts.

5. The current limiting circuit breaker of claim 1 wherein said support lever includes a corresponding pair of projections extending therefrom and contacting said movable contact arms to said open position.

6. The current limiting circuit breaker of claim 1 wherein said connecting lever includes a corresponding pair of projections extending therefrom and contacting said movable contact arms and driving said movable contact arms to said open position when said electromagnetic actuator is de-energized.

7. The current limiting circuit breaker of claim 1 wherein said electromagnetic actuator comprises a fixed magnetic core and a spring-biased movable armature, said movable armature being attached to a first bell crank lever having a projection extending from one end and received within a slot formed on one end of said connecting lever.

8. The current limiting circuit breaker of claim 7 including a driving rod connecting between said first bell crank lever and a second bell crank lever including indicia visible from an exterior of said second case to indicate said open condition of said fixed and movable contacts.

* * * * *